US011844970B2

(12) United States Patent
Sinha et al.

(10) Patent No.: US 11,844,970 B2
(45) Date of Patent: Dec. 19, 2023

(54) SYSTEM AND METHOD FOR GUIDING A USER OPERATING A FIRE EXTINGUISHER

(71) Applicant: CARRIER CORPORATION, Palm Beach Gardens, FL (US)

(72) Inventors: Ashis Kumar Sinha, Telangana (IN); Harshal Chaudhari, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/252,933

(22) PCT Filed: Aug. 24, 2020

(86) PCT No.: PCT/IB2020/057901

§ 371 (c)(1),
(2) Date: Dec. 16, 2020

(87) PCT Pub. No.: WO2021/048668

PCT Pub. Date: Mar. 18, 2021

(65) Prior Publication Data

US 2022/0193472 A1 Jun. 23, 2022

(30) Foreign Application Priority Data

Sep. 12, 2019 (IN) ..... 201911036642

(51) Int. Cl.
*A62C 13/76* (2006.01)
*G08B 7/06* (2006.01)
*G08B 21/02* (2006.01)

(52) U.S. Cl.
CPC ..... *A62C 13/76* (2013.01); *G08B 7/06* (2013.01); *G08B 21/02* (2013.01)

(58) Field of Classification Search
CPC ..... A62C 13/76; G08B 7/06; G08B 21/02
See application file for complete search history.

(56) References Cited

U.S. PATENT DOCUMENTS 5,460,228 A * 10/1995 Butler ..... A62C 13/76 340/568.1
7,726,411 B2 6/2010 McSheffrey, Jr. et al.
7,907,048 B1 * 3/2011 Werner ..... A62C 13/76 340/384.1

(Continued)

FOREIGN PATENT DOCUMENTS

CN 208959189 U * 6/2019
CN 208959189 U 6/2019
KR 20190068016 A * 6/2019

(Continued)

OTHER PUBLICATIONS

International Search Report and Written Opinion for Application No. PCT/IB2020/057901; dated Dec. 14, 2020; 15 pages.

*Primary Examiner* — Quan Zhen Wang
*Assistant Examiner* — Rajsheed O Black-Childress
(74) *Attorney, Agent, or Firm* — CANTOR COLBURN LLP

(57) ABSTRACT

A system comprising a fire extinguisher, one or more indicator devices disposed on the fire extinguisher adapted to actuate in a series representing a series of operations to be performed by a user for extinguishing a fire with the fire extinguisher, and a controller for controlling the actuation series of the one or more indicator devices.

20 Claims, 4 Drawing Sheets

(56) References Cited

U.S. PATENT DOCUMENTS

2017/0259093 A1 9/2017 Tan

FOREIGN PATENT DOCUMENTS

| | | | | | |
|---|---|---|---|---|---|
| KR | 20190068016 | A | | 6/2019 | |
| KR | 20190098442 | A | * | 8/2019 | |
| KR | 20190098442 | A | | 8/2019 | |
| WO | 03086547 | A1 | | 10/2003 | |
| WO | WO-2020031037 | A1 | * | 2/2020 | ..... A62C 13/76 |

* cited by examiner

SYSTEM AND METHOD FOR GUIDING A USER OPERATING A FIRE EXTINGUISHER

CROSS-REFERENCE TO RELATED APPLICATIONS

This application is a National Stage Application of PCT/IB2020/057901, filed Aug. 24, 2020, which claims priority to India Application No. 201911036642, filed Sep. 12, 2019, the disclosures of which are incorporated herein by reference.

TECHNICAL FIELD OF INVENTION

The present invention generally relates to a system and method for guiding a user for performing an activity. More particularly, the present invention relates to a system and method for guiding a user while using a fire extinguisher during a fire emergency.

BACKGROUND OF THE INVENTION

During a fire outbreak or emergency, fire extinguishers are generally used to control the outbreak of fire. Individuals are trained for the same so that in case of an emergency, the individuals have the required skills to operate the fire extinguisher.

However, it is seen that individuals, even if they are trained to use fire extinguishers panic and are not able to use the fire extinguisher effectively. Such individuals may miss to pull the safety pin, get confused whether the fire extinguisher is the right one for that particular fire type, and/or how far the extinguisher needs to be placed from the fire while extinguishing it, when should the user leave the area etc., impacting the usability of the fire extinguisher.

Therefore, there is a need in the art for systems and methods that can assist and guide a user to use a fire extinguisher.

SUMMARY OF THE INVENTION

Various embodiments of the invention describe a system comprising a fire extinguisher, one or more indicator devices disposed on the fire extinguisher adapted to actuate in a series representing a series of operations to be performed by a user for extinguishing a fire with the fire extinguisher, and a controller for controlling the actuation series of the one or more indicator devices.

In an embodiment of the invention, the one or more indicator devices comprises Light Emitting Diodes (LEDs). According to some aspects the LEDs are positioned on a pull-pin, a hose, and a release lever of the fire extinguisher. In another embodiment of the invention, the LEDs are positioned on an instructions' region on the surface of the fire extinguisher.

In another embodiment of the invention, the one or more indicator devices comprises a speaker. In an embodiment of the invention, the speaker is positioned on the fire extinguisher.

In yet another embodiment of the invention, the one or more indicator devices comprises a haptic actuator. In an embodiment of the invention, haptic actuators are positioned on the pull-pin, hose, and release lever of the fire extinguisher.

In still another embodiment of the invention, the one or more indicator devices comprises a display screen. In an embodiment of the invention, the display screen is positioned on the surface of the fire extinguisher.

In an embodiment of the invention, the controller comprises a communication module adapted to communicate to a wireless network, a memory for storing the actuation series; and a battery for providing electrical energy.

In an embodiment of the invention, one or more sensors are positioned on the fire extinguisher. In an embodiment of the invention, the one or more sensors comprises at least one of a temperature sensor, a haptic sensor, a motion sensor, a pressure sensor, or a smoke detector.

Various embodiments of the invention also describe a method comprising actuating one or more indicator devices, and controlling the actuation of the one or more indicator devices in an actuation series by a controller, where, the actuation series corresponds to a series of operations to be performed by a user for extinguishing a fire with a fire extinguisher.

In an embodiment of the invention, the actuation series comprises actuating the one or more indicator device in timed intervals to indicate to a user to pull a pull-pin, aim a hose, and squeeze a release lever of the fire extinguisher.

In an embodiment of the invention, the one or more indicator devices comprises light emitting diodes (LEDs), and wherein the actuation series comprises illuminating LEDs positioned on the pull-pin, the hose, and the release lever of the fire extinguisher.

In another embodiment of the invention, the one or more indicator devices comprises a speaker, and wherein the actuation series comprises actuating the speaker to produce sounds. In an embodiment of the invention, the sounds produced by the speaker comprising pre-recorded spoken instructions to operate the fire extinguisher.

In yet another embodiment of the invention, the one or more indicator devices comprises haptic actuators, and wherein the actuation series comprises actuating haptic actuators positioned on a pull-pin, a hose, and a release lever of a fire extinguisher.

In still another embodiment of the invention, the one or more indicator devices comprises a display screen, and where the actuation series comprises displaying visuals on the display screen.

In an embodiment of the invention, the method comprises detecting occurrence of an event via one or more sensors including at least one of a temperature sensor, haptic sensor, a motion sensor, pressure sensor, or a smoke detector.

This summary is provided to introduce a selection of concepts in a simplified form from those that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF ACCOMPANYING DRAWINGS

Corresponding reference numerals indicate corresponding parts throughout the drawings.

DETAILED DESCRIPTION OF INVENTION

The following detailed description should be read with reference to the drawings in which similar elements in different drawings are numbered the same. The drawings, which are not necessarily to scale, depict illustrative embodiments and are not intended to limit the scope of the invention. Although examples of construction, dimensions, and materials are illustrated for the various elements, those skilled in the art will recognize that many of the examples provided have suitable alternatives that may be utilized.

Described herein is a system comprising a fire extinguisher, one or more indicator devices disposed on the fire extinguisher adapted to actuate in a series representing a series of operations to be performed by a user for extinguishing a fire with the fire extinguisher, and a controller for controlling the actuation series of the one or more indicator devices.

Also described herein is a method comprising actuating one or more indicator devices, and controlling the actuation of the one or more indicator devices in an actuation series by a controller, where, the actuation series corresponds to a series of operations to be performed by a user for extinguishing a fire with a fire extinguisher.

Figure 1:
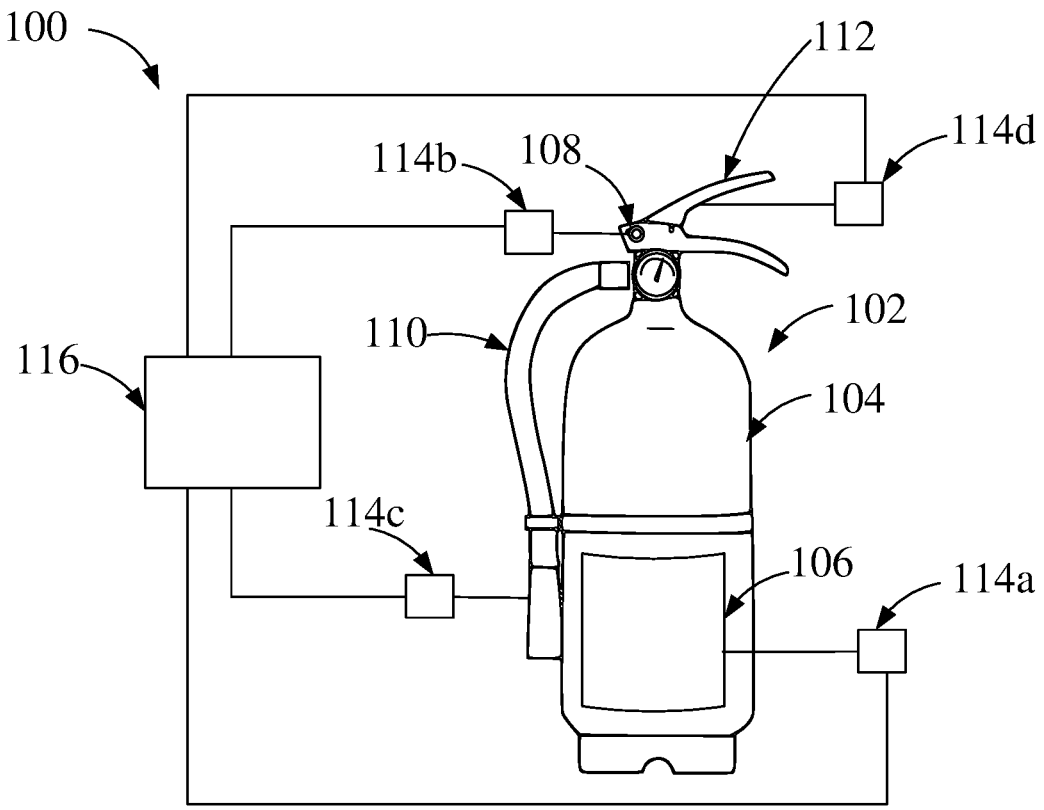
FIG. 1 is a block diagram of a first embodiment of a system for guiding a user in using a fire extinguisher during a fire emergency.

FIG. 1 is a block diagram of a first embodiment of a system 100 for guiding a user in using a fire extinguisher 102 during a fire emergency. The system 100 comprises the fire extinguisher 102, which further includes a body 104, an instructions' region 106, a pull-pin 108, a hose 110, and a release lever 112, a number of indicator devices 114 (114*a*, 114*b*, 114*c*, 114*d*), and a controller 116.

The body 104, pull-pin 108, hose 110, and the release lever 112 of the fire extinguisher 102 are well known in the art and hence their construction and functioning in detail are not discussed herein.

The instructions' region 106 is a region on the exterior surface of the body 104 that has instructions for a user. In some embodiments, the instructions are written, pictorial, or both that relate to the class of fire that the fire extinguisher 102 is capable of extinguishing, such as Class A—fires that involves solid materials like wood, paper, textiles; Class-B— fires that involve flammable liquids, etc. In some embodiments, the instructions' region 106 also includes a set of instructions, written, pictorial, or both that guide the user in using the fire extinguisher 102. In some embodiments, the instructions' region 106 is an instruction guide sticker pasted onto the body 104 of the fire extinguisher 102.

The indicator devices 114 are devices that draw attention of the user by providing visual, auditory, or haptic stimulations to the user in order to guide the user for using the fire extinguisher 102. In some embodiments, the indicator devices 114 are actuated to produce visual, auditory, or haptic stimulations in an actuation series or a predefined pattern representing the series of operations to be performed by the user for extinguishing a fire with the fire extinguisher 102.

In some embodiments, the indicator devices 114 include Light Emitting Diodes (LEDs) that illuminate to draw attention of the user. The LEDs are positioned along the instructions' region 106, pull-pin 108, hose 110, and release lever 112.

In some embodiments, the indicator devices 114 include audio buzzers or speakers that produce an audio output to draw the attention of the user. In some embodiments, audio buzzers can be positioned along the instructions' region 106, pull-pin 108, hose 110, and release lever 112. In some other embodiments, a single audio speaker is placed on the body 104.

In some embodiments, the indicator devices 114 include haptic actuators that provide haptic stimulation, such as vibration, to draw the attention of the user. In some embodiments, the haptic actuators are positioned along the instructions' region 106, pull-pin 108, hose 110, and release lever 112.

In some embodiments, the indicator devices 114 include display screens that provide visual stimulations to draw the attention of the user. In some embodiments, display screens are positioned along the instructions' region 106, pull-pin 108, hose 110, and release lever 112. In some other embodiments, a single display screen is positioned on the body 104. In some embodiments, the single display screen is positioned along to the instructions' region 106. In some other embodiments, the single display screen is positioned in place of the instructions' region 106 and functions as the instructions' region 106.

In some embodiments, as shown in FIG. 1, a first set of indicator devices 114*a* are positioned along the instructions' region 106, a second set of indicator devices 114*b* are positioned along the pull-pin 108, a third set of indicator devices 114*c* are positioned along the hose 110, and a fourth set of indicator devices 114*d* are positioned along with the release lever 112. In some embodiments, each set of indicator devices 114*a*, 114*b*, 114*c*, 114*d*, include various combinations of different types of indicator devices, such as LEDs, audio buzzers or speakers, haptic actuators, display screens, as discussed above. In some other embodiments, each set 114*a*, 114*b*, 114*c*, 114*d* includes just one such device, for example, in one such embodiment, an LED is positioned along each of the instructions' region 106, pull-pin 108, hose 110, and release lever 112. In yet some other embodiments, different types and combinations of indicator devices are present in each set 114*a*, 114*b*, 114*c*, 114*d*; for example, in one such embodiment, a display screen and an audio speaker are placed along the instructions' region 106, and an LED and a haptic actuator are placed along each of the pull-pin 108, hose 110, and release lever 112.

The indicator devices 114 are operably connected to the controller 116 via wired or wireless connection. In some embodiments, the controller 116 is a micro-controller or micro-processor programmed to actuate the indicator devices 114 in the actuation series to guide the user. In some embodiments, the controller 116 is coupled with a data storage medium, such as a Read Only Memory (ROM) that stores the actuation series. In some embodiments, the controller 116 is coupled to a communication module configured to communicate via wired or wireless networks. For example, in an embodiment, the controller 116 is coupled to a Bluetooth Low Energy (BTLE) module. In another embodiment, the controller 116 is coupled to a Wireless Fidelity (Wi-Fi) module. In yet another embodiment, the controller 116 is coupled to a Radio Frequency (RF) module. In some embodiments, the controller 116 is coupled with a power source, such as a battery, to power the controller 116, the data storage medium, communication module, the indicator devices 114, sensors, display devices, and other ancillary devices that may be part of any embodiment of the system 100.

In some embodiments, the controller 116, data storage medium, communication module, and the battery are encased in a cavity in the body 104. In some other embodiments, the controller 116, data storage medium, and the battery are enclosed in a case or a pouch external to the body 104 that can be attached to the body 104.

Figure 2:
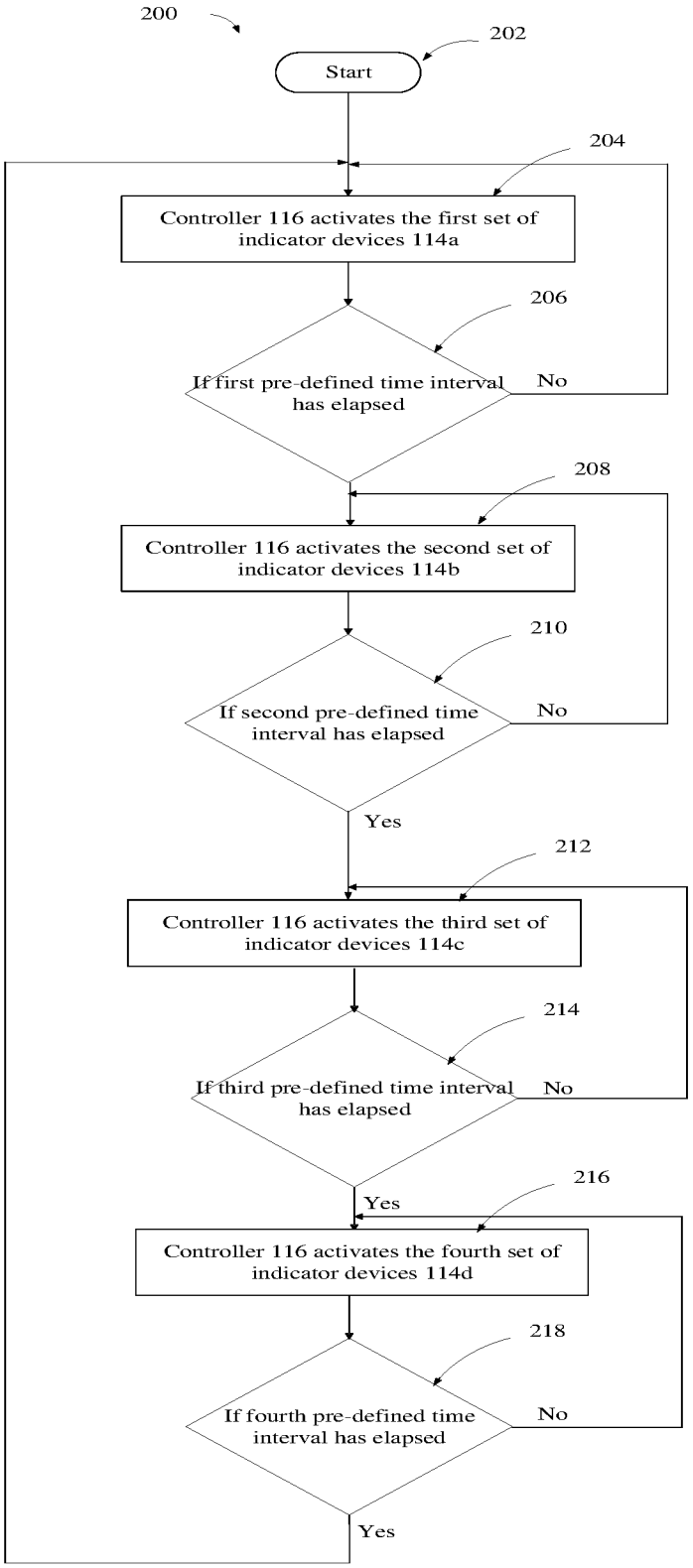
FIG. 2 is a flow chart representing a method for guiding a user in using a fire extinguisher during a fire emergency using the system of FIG. 1.

FIG. 2 is a flow chart representing a method 200 for guiding the user in using the fire extinguisher 102 during a fire emergency using the system 100 of FIG. 1.

In some embodiments, the method 200 may be initiated by turning on a switch that couples the controller 116 and the power source. In some other embodiments, the method may be initiated by a sensor detecting the removal of the fire extinguisher 102 from its mounting place. The method flow chart starts at step 202.

At a step 204, the controller 116 activates the first set of indicator devices 114*a* on an instructions' region 106 indicating to the user the type of fire the fire extinguisher 102 can extinguish and the steps to be performed by the user to extinguish the fire. In some embodiments, the controller 116 may sense the amount of pressure of extinguishing material within the body 104 of the fire extinguisher to determine the usability of the fire extinguisher 102 via a pressure sensor or pressure gauge. In case the pressure of the extinguishing material is below a certain threshold. The controller 116 may abandon the below steps and indicate to the user via indicator devices 114*a* that the fire extinguisher 102 is not usable and the user should move away from the fire as soon as possible.

At a step 206, the controller 116 runs a timer to determine if a first predefined time interval has elapsed since the actuation of the first set of indicator devices 114*a*. The first pre-defined time interval can by any time interval sufficiently long enough to draw the attention of the user towards the instructions' region 106. In some embodiments, the first pre-defined time interval ranges between 0.25 seconds to 10 seconds. In some other embodiments, the first pre-defined time interval ranges between 0.25 seconds to 4 seconds. The controller 116 keeps the first set of indicator devices 114*a* actuated during the first pre-defined time interval.

At step 208, when the first pre-defined time interval elapses the controller 116 activates the second set of indicator devices 114*b* positioned along the pull-pin 108 indicating the user to pull the pull-pin 108. In some embodiments, the controller 116 shuts-off the first set of indicator devices 114*a* at this moment. In some other embodiments, the controller 116 continues to actuate the first set of indicator devices 114*a* along with the second set of indicator devices 114*b*.

At step 210, the controller 116 runs the timer to determine if a second predefined time interval has elapsed since the actuation of the second set of indicator devices 114*b*. The second pre-defined time interval can by any time interval sufficiently long enough to draw the attention of the user towards the pull-pin 108. In some embodiments, the second predefined time interval is longer than the first predefined time interval. In some other embodiments, the second pre-defined time interval is shorter than the first predefined time interval. In yet some other embodiments, the second pre-defined time interval and the first predefined time interval are equal. The controller 116 keeps the second set of indicator devices 114*b* actuated during the pre-defined time interval.

At step 212, when the second pre-defined time interval elapses, the controller 116 activates the third set of indicator devices 114*c* positioned along the hose 110 indicating to the user to aim the hose 110 at the fire. In some embodiments, the controller 116 shuts-off the second set of indicator devices 114*b* at this moment. In some other embodiments, the controller 116 continues to actuate the second set of indicator devices 114*b* along with the third set of indicator devices 114*c*.

At step 214, the controller 116 runs the timer to determine if a third predefined time interval has elapsed since the actuation of the third set of indicator devices 114*c*. The third pre-defined time interval can be any time interval sufficiently long enough to draw the attention of the user towards the hose 110. In some embodiments, the third predefined time interval is longer than the second predefined time interval. In some other embodiments, the third predefined time interval is shorter than the second predefined time interval. In yet some other embodiments, the third pre-defined time interval and the second predefined time interval are equal. The controller 116 keeps the third set of indicator devices 114*c* actuated during the third pre-defined time interval.

At step 216, when the third pre-defined time interval elapses the controller 116 activates the fourth set of indicator devices 114*d* positioned along the release lever 112 indicating to the user to squeeze the release lever 112. In some embodiments, the controller 116 shuts-off the third set of indicator devices 114*c* at this moment. In some other embodiments, the controller 116 continues to actuate the third set of indicator devices 114*c* along with the fourth set of indicator devices 114*d*.

At step 218, the controller 116 runs the timer to determine if a fourth predefined time interval has elapsed since the actuation of the fourth set of indicator devices 114*d*. The fourth pre-defined time interval can by any time interval sufficiently long enough to draw the attention of the user towards the release lever 112. In some embodiments, the fourth predefined time interval is longer than the third predefined time interval, in some other embodiments, the fourth predefined time interval is shorter than the third predefined time interval, in yet some other embodiments, the fourth predefined time interval and the third predefined time interval are equal. The controller 116 keeps the fourth set of indicator devices 114*d* actuated during the fourth pre-defined time interval. Further, in some embodiments, the third set of indicator devices 114*c* are positioned on the hose 110 such that the controller 116 can actuate the third set of indicator devices 114*c* in such a sequence that indicates to the user to sweep the nozzle of the hose 110 from side to side at the fire to help the user in extinguishing the fire when the user squeezes the release lever 112. The controller 116 can stop actuating the third set of indicator devices 114*c* when all the fire extinguishing material is released from the fire extinguisher 102.

When the fourth pre-defined time interval elapses the controller 116 may re-initiate the step 204. The method 200 continues in a loop until the connection between the controller 116 and the power source is disconnected by turning off of a switch or by any sensor detecting that the fire extinguisher is placed back in its mounting place by the user. If the sensor determines that fire is extinguished, the same can be displayed on the display screen or can be communicated by the speaker.

Figure 3:
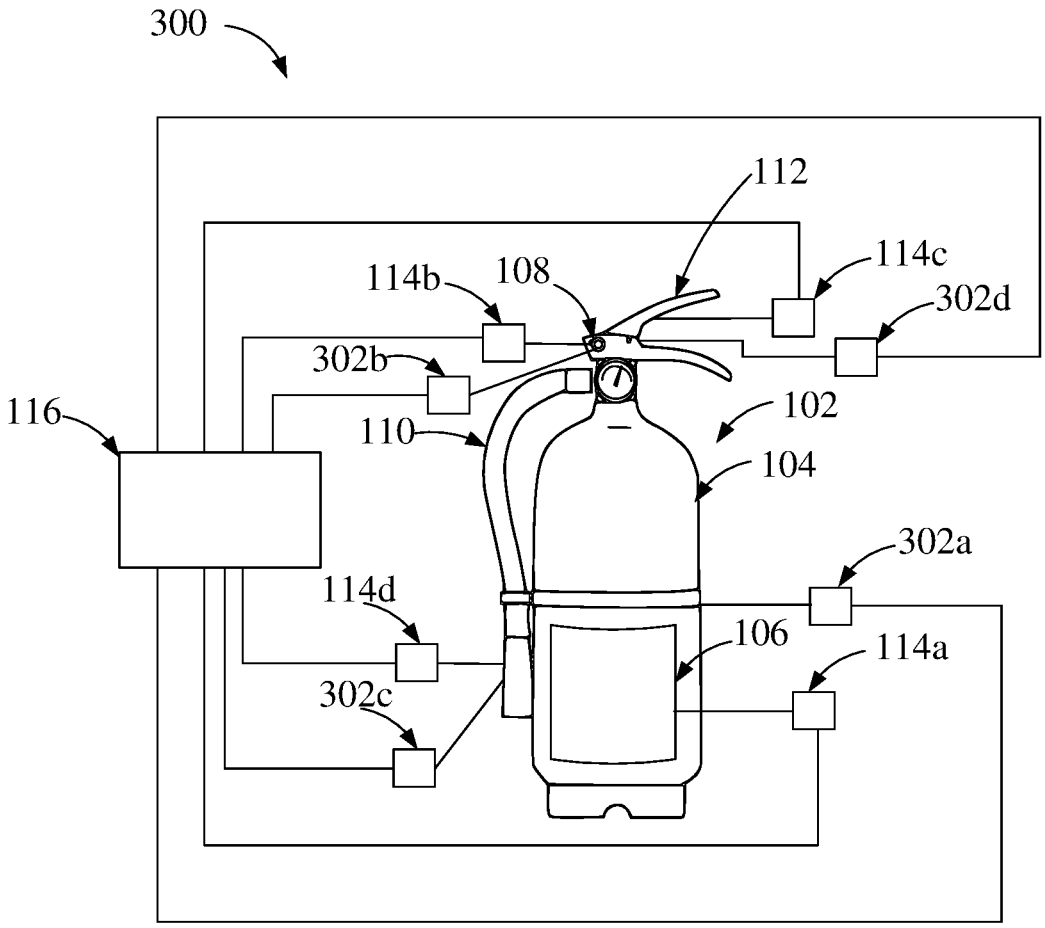
FIG. 3 is a block diagram of a second embodiment of the system for guiding a user in using a fire extinguisher during a fire emergency.

FIG. 3 is a block diagram of a second embodiment of the system 300 for guiding a user in using the fire extinguisher 102 during a fire emergency. The system 300 includes a number of sensors 302 that sense various stages of use of the fire extinguisher 102 by the user. A first set of sensors 302*a* positioned on the body 104 senses that the user picked up the fire extinguisher 102 from its mounting place. A second set of sensors 302*b* positioned proximate to the pull-pin 108, senses when the user pulls the pull-pin 108 out of the fire extinguisher 102. A third set of sensors 302*c* positioned proximate to the hose 110 senses when the hose 110 is extended out of its resting position by the user. A fourth set of sensors 302*d* positioned proximate to the release lever 112 senses when the release lever 112 is squeezed by the user. The sensors 302 can be selected from a wide variety of sensors, such as motion sensors, voltage sensors, IR sensors, light sensors, pressure sensors, etc. Since such sensors are widely known in the art, the construction and features of such sensors 302 are not discussed in detail herein. A person skilled in the art can contemplate various types of sensor and their arrangements.

The controller 116 is connected to the sensors 302 and unlike the previous embodiment (system 100) where the indicator devices 114 were actuated by the controller 116 after predefined time intervals, in this embodiment (system 300), the controller 116 controls the actuation of the indicator devices 114 based on the inputs received from the sensors 302.

Figure 4:
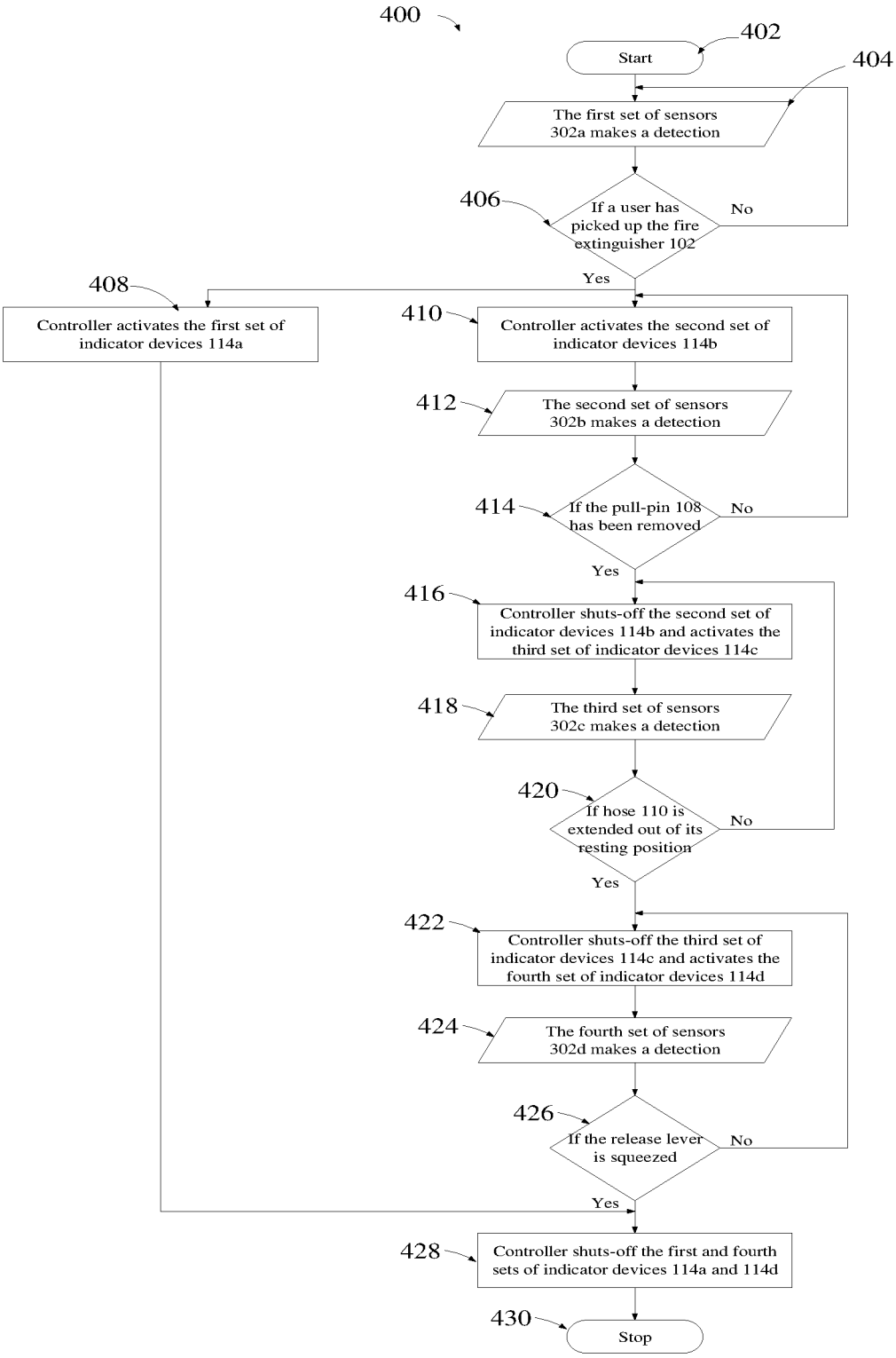
FIG. 4 is a flow chart representing a method for guiding a user in using a fire extinguisher during a fire emergency using the system of FIG. 3.

FIG. 4 is a flow chart representing a method 400 for guiding a user in using a fire extinguisher during a fire emergency using the system 300 of FIG. 3.

In this embodiment before initiation of the method, the controller 116 may be continuously active in a sleep or low power mode and monitoring the sensors 302 periodically to determine if the user has picked up the fire extinguisher 102. The method flow chart starts at step 402.

At step 404, the first set of sensors 302*a* makes a detection to determine whether a user has picked up the fire extinguisher 102 or not.

At step 406, the controller 116 processes the detection and determines whether a user has picked up the fire extinguisher 102 from its mounting place. If the controller 116 determines that the fire extinguisher 102 was not picked up from its mounting place, the controller 116 continues to monitor the sensors 302*a* by returning to the step 402. If the controller 116 determines that the user has picked up the fire extinguisher 102 from its mounting place, two parallel processes/steps 408 and 410 are initiated.

At step 408, the controller 116 activates the first set of indicator devices 114*a* on the instructions' region 106 to indicate to the user the type of fire the fire extinguisher can extinguish and the steps to be followed to perform the task of extinguishing the fire. In some embodiments, the controller 116 may sense the amount of pressure of extinguishing material within the body 104 of the fire extinguisher to determine the usability of the fire extinguisher 102 via a pressure sensor or pressure gauge. In case the pressure of the extinguishing material is below a certain threshold. The controller 116 may abandon the below steps and indicate to the user via indicator devices 114*a* that the fire extinguisher 102 is not usable and the user should move away from the fire as soon as possible.

At parallel step 410, the controller 116 activates the second set of indicator devices 114*b* positioned proximate the pull-pin 108 to indicate to the user to pull the pull-pin 108.

At step 412, the second set of sensors 302*b* makes a detection to determine whether the user has pulled the pull-pin 108 out of the fire extinguisher 102 or not.

At step 414, the controller 116 processes the detection of sensors 302*b* and determines whether the pull-pin 108 has been removed from the fire extinguisher 102 or not. If the pull-pin 108 has not been removed from the fire extinguisher 102, then the method returns to step 410, else the method moves to step 416.

At step 416, the controller 116 shuts-off the second set of indicator devices 114*b* and activates the third set of indicator devices 114*c* positioned proximate the hose 110 to indicate to the user to aim the hose 110 at the fire.

At step 418, the third set of sensors 302*c* make a detection whether the user has extended the hose 110 from its resting position or not.

At step 420, the controller 116 processes the detection of sensors 302*c* and determines whether the hose 110 is extended out of its resting position by the user or not. If the hose 110 has not been extended out of its resting position, then the method returns to step 416, else the method moves to step 422. In some embodiments, a sensor, such as an IR sensor, a temperature sensor, or any other kind of heat detecting sensor is placed on the hose 110. In such embodiments, the controller 116 may sense the direction of fire using the signals from the sensor. The controller 116 may actuate the third set of indicator devices 114*c* in a sequence that indicates to the user to extend the hose 110 in the direction of the fire.

At step 422, the controller 116 shuts-off the third set of indicator devices 114*c* and activates the fourth set of indicator devices 114*d* positioned proximate the release lever 112 to indicate to the squeeze the release lever 112 to release the extinguishing material/gas onto the fire.

At step 424, the fourth set of sensors 302*d* make a detection to determine if the user has squeezed the release lever 112 or not.

At step 426, the controller 116 processes the detection of sensors 302*d* and determines whether the user has squeezed the release lever 112 or not. If the release lever 112 is not squeezed, then the method returns to step 422, else the method moves to step 428.

At step 428, the controller 116 shuts-off the indicator devices 114*a* and the indicator devices 114*d*. In some embodiments, the third set of indicator devices 114*c* are positioned on the hose 110 such that the controller 116 actuates the third set of indicator devices 114*c* in a sequence that indicates to the user to sweep the nozzle of the hose 110 from side to side at the fire to help the user in extinguishing the fire when the user squeezes the release lever 112. The controller 116 can stop actuating the third set of indicator devices 114*c* when all the fire extinguishing material is released from the fire extinguisher 102.

At step 430, the method stops.

The system 300 may include additional sensors to sense the environmental conditions of the fire extinguisher. In some embodiments, the system 300 includes ambient temperature sensor to detect the temperature around the fire extinguisher 102. Further, the method 400 may include additional steps, for example, in the embodiments having temperature sensors, the controller 116 may via any of the indicator devices 114 mentioned above or any additional indicator devices to warn the user to evacuate the area if the ambient temperature exceeds a pre-defined threshold, for example 60° C. Other additional sensors that may be added to the system 300 may include smoke detectors, sensors to detect poisonous gasses, etc.

With reference to FIGS. 1-4, in some embodiment of the invention, the invention can be operated using the one or more computer readable devices. The one or more computer readable devices can be associated with the controller 116. A computer readable medium comprising one or more processors and a memory coupled to the one or more processors, the memory storing instructions which are executed by the one or more processors, the one or more processors configured to perform the steps of the methods 200 or 400 as discussed above.

Exemplary computer readable media includes flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purpose or special purpose computing system environments, configurations, or devices.

Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures/Tables and described herein. Other examples of the invention may include different computer-executable instructions or components having more or less functionality than illustrated and described herein.

Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

As it employed in the subject specification, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Processors can exploit nano-scale architectures such as, but not limited to, molecular and quantum-dot based transistors, switches and gates, in order to optimize space usage or enhance performance of user equipment. A processor may also be implemented as a combination of computing processing units.

In the subject specification, terms such as "data store," "data storage," "database," "cache," and substantially any other information storage component relevant to operation and functionality of a component, refer to "memory components," or entities embodied in a "memory" or components comprising the memory. It will be appreciated that the memory components, or computer-readable storage media, described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

Furthermore, the terms "user," refers to human entities and so forth that can operate the fire extinguisher 102 disclosed herein.

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C".

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A system comprising a controller and a data storage medium coupled to the controller, wherein the controller performs operations comprising:

controlling a plurality of indicator devices, wherein each of the plurality of indicator devices is positioned on a corresponding one of a plurality of predetermined portions of a fire extinguisher;

determining, based at least in part on data from a sensor network, that a user has picked up the fire extinguisher;

subsequent to determining that the user has picked up the fire extinguisher, determining, based at least in part on data from the sensor network, an amount of pressure of extinguishing material within the fire extinguisher and making a determination whether or not the amount of pressure of the extinguishing material is below a threshold pressure;

concurrently with determining the amount of pressure, actuating each of the plurality of indicator devices in a series representing a series of operations to be performed at the plurality of predetermined portions of the fire extinguisher by a user for extinguishing a fire with the fire extinguisher; and based at least in part on a result of the determination whether or not the amount of pressure of the extinguishing material is below the threshold pressure, abandoning actuating each of the plurality of indicating devices and generating an indication that notifies the user that the fire extinguisher is not usable.

2. The system of claim 1, wherein the plurality of indicator devices comprises Light Emitting Diodes (LEDs).

3. The system of claim 2, wherein the plurality of predetermined portions of the fire extinguisher comprises a pull-pin, a hose, a release lever and an instruction's region on a surface of the fire extinguisher.

4. The system of claim 1, wherein the plurality of indicator devices comprises a speaker.

5. The system of claim 1, wherein the plurality of indicator devices comprises a haptic actuator.

6. The system of claim 5, wherein the haptic actuator is positioned on a pull-pin, a hose, and a release lever of the fire extinguisher.

7. The system of claim 1, wherein the plurality of indicator devices comprises a display screen.

8. The system of claim 7, wherein the display screen is positioned on a surface of the fire extinguisher.

9. The system of claim 1, wherein the controller comprises:

a communication module adapted to communicate to a wireless network;

a memory for storing the actuation series; and a battery for providing electrical energy.

10. The system of claim 1, wherein sensors are positioned on the fire extinguisher.

11. The system of claim 10, wherein the sensors comprise at least one of a temperature sensor, a haptic sensor, a motion sensor, a pressure sensor, or a smoke detector.

12. A method comprising using a controller to perform operations comprising:

controlling a plurality of indicator devices, wherein each of the plurality of indicator devices is positioned on a corresponding one of a plurality of predetermined portions of a fire extinguisher;

determining, based at least in part on data from a sensor network, that a user has picked up the fire extinguisher;

subsequent to determining that the user has picked up the fire extinguisher, determining, based at least in part on data from the sensor network, an amount of pressure of extinguishing material within the fire extinguisher and making a determination whether or not the amount of pressure of the extinguishing material is below a threshold pressure;

concurrently with determining the amount of pressure, actuating each of a plurality of indicator devices in a series representing a series of operations to be performed at the plurality of predetermined portions of the fire extinguisher by a user for extinguishing a fire with the fire extinguisher; and based at least in part on a result of the determination whether or not the amount of pressure of the extinguishing material is below the threshold pressure, abandoning actuating each of the plurality of indicating devices and generating an indication that notifies the user that the fire extinguisher is not usable.

13. The method of claim 12, wherein the series of operations comprise using the plurality of indicator devices to indicate to the user to pull a pull-pin, aim a hose, and squeeze a release lever of the fire extinguisher.

14. The method of claim 12, wherein the plurality of indicator devices comprise light emitting diodes (LEDs), and wherein the series of operations comprises illuminating LEDs positioned on the pull-pin, the hose, the release lever, and an instructions' region of the fire extinguisher.

15. The method of claim 12, wherein the plurality of indicator devices comprises a speaker, and wherein the series of operations comprises actuating the speaker to produce sounds.

16. The method of claim 15, wherein the sounds produced by the speaker comprise pre-recorded spoken instructions to operate the fire extinguisher.

17. The method of claim 12, wherein the plurality of indicator devices comprises haptic actuators, and wherein the series of operations comprises actuating haptic actuators positioned on a pull-pin, a hose, and a release lever of the fire extinguisher.

18. The method of claim 12, wherein the plurality of indicator devices comprises a display screen, and wherein the series of operations comprises displaying visuals on the display screen.

19. The method of claim 12, wherein determining that the user has picked up the fire extinguisher is based at least in part on sensor data.

20. The method of claim 19, wherein the operations further comprise, based at least in part on the result of the determination being that that the amount of pressure of the extinguishing material is below the threshold pressure, indicating to the user to leave a location.

* * * * *